United States Patent [19]

Pepersack et al.

[11] Patent Number: 4,474,098

[45] Date of Patent: Oct. 2, 1984

[54] SIGNAL EMITTING DEVICE WITH ADJUSTABLE BEAT FREQUENCY

[76] Inventors: Walter Pepersack, in der Gand-Strasse 1, Zumikon 8126; Charles Jungo, Hasenbühlweg 30, Zug 6300, both of Switzerland

[21] Appl. No.: 433,208

[22] PCT Filed: Jan. 22, 1982

[86] PCT No.: PCT/EP82/00011

§ 371 Date: Sep. 27, 1982

§ 102(e) Date: Sep. 27, 1982

[87] PCT Pub. No.: WO82/02610

PCT Pub. Date: Aug. 5, 1982

[30] Foreign Application Priority Data

Jan. 27, 1981 [CH] Switzerland ..... 515/81

[51] Int. Cl.[3] ..... G10F 1/00

[52] U.S. Cl. ..... 84/1.03; 84/470 R; 84/DIG. 12; 84/1.27

[58] Field of Search ..... 84/1.03, 1.26, 1.27, 84/470 R, DIG. 12; 368/273

[56] References Cited

U.S. PATENT DOCUMENTS

| | | | |
|---|---|---|---|
| 4,014,167 | 3/1977 | Hasegawa et al. | 84/1.03 |
| 4,089,246 | 5/1978 | Kooker | 84/1.03 X |
| 4,181,059 | 11/1980 | Weber | 84/1.24 |
| 4,213,372 | 7/1980 | Sasaki et al. | 84/470 R |
| 4,297,934 | 11/1981 | Imamura et al. | 84/1.03 |
| 4,368,989 | 1/1983 | Kawashima | 368/273 |
| 4,388,000 | 6/1983 | Hagihira | 368/273 |

*Primary Examiner*—Forester W. Isen

[57] ABSTRACT

On a first keyboard (4) the time value of each musical note and/or the time value of each pause of the musical sequence to be reproduced is introduced. After the introduction of each note value, the respective pitch value of this note can be introduced with the aid of a second keyboard (50). The introduced sequence can inlude up to 8 measures and is reproduced repeatedly after actuating a start switch (11) on a visual display (13) and/or with an acoustic output (34) in a frequency which is selected with the help of a switch (20). The visual display (13) has (4) seven segments elements which show the sequence continuously, measure after measure. The acoustic output (34) can produce, at choice, white noise signals or sounds. The white noise signals have impulses which decrease exponentially from a maximum.

10 Claims, 4 Drawing Figures

Fig. 3
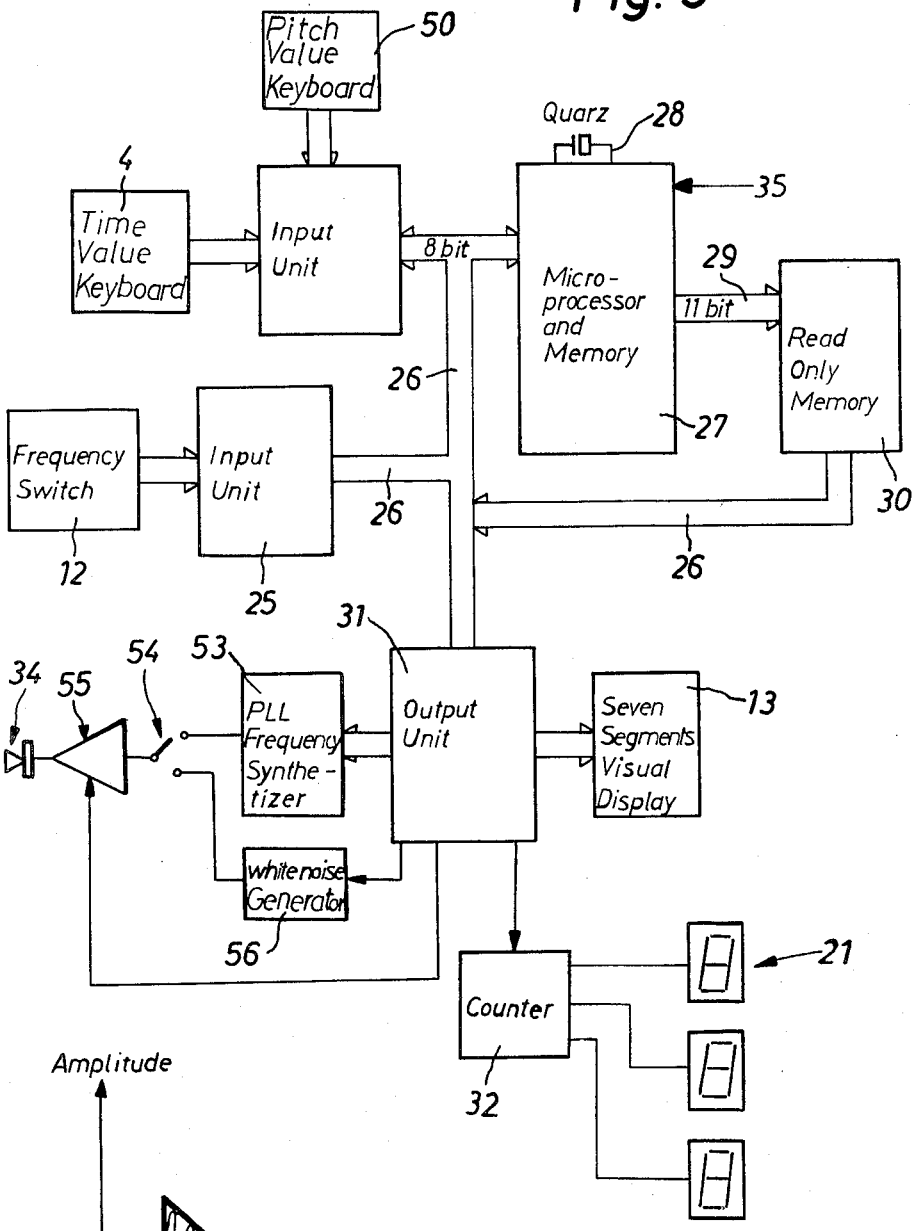
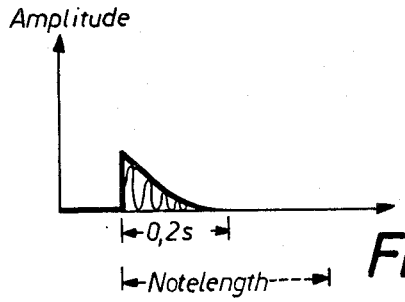
Fig.4

SIGNAL EMITTING DEVICE WITH ADJUSTABLE BEAT FREQUENCY

BACKGROUND OF THE INVENTION

The invention relates to a new and improved construction of a signal emitting device with adjustable beat frequency comprising an input unit for the introduction of a sequence of time values of musical notes or pauses which define at least one measure, a memory unit for storing the introduced sequence and a circuit for repeatedly producing control signals representing the introduced sequence as a function of the selected beat frequency.

Such devices can be used as metronome. After the introduction of the selected sequence of time values of musical notes and pauses, which is easily possible also for a beginner, the corresponding rhythm is reproduced with the selected beat frequency. The beat frequency can initially be set low for training and can later be set at a higher value without changing the structure of the introduced musical measure.

Such known devices are a better help in learning a musical composition than the usual metronomes with acoustic or visual output because the while the person being trained is able to understand the rhythm of the difficult passages, the succession of the tones of a melody cannot be reproduced because the acoustic signals are uniform.

There are some cases in which it is desired to have, at least temporarily, in addition to the mere rhythm, the reproduction of the succession of tones of a musical composition, e.g. in singing lessons, since beginners are often not sure of the pitch of each tone.

BRIEF SUMMARY OF THE INVENTION

In accordance with the foregoing, it is a general object of the present invention to provide an improved construction of a signal emitting device with adjustable beat frequency which is suited to reproduce not only the rhythm but also the melody of a musical composition.

Another object of the invention is to provide a new and improved signal emitting device which is extremely easy to operate so that the user does not require a deep musical knowledge.

Finally, it is an object of the invention to provide a device which is suited for children as a mere beat emitting device or as a melody box.

Now, in order to implement these and still further objects of the invention, which will become more readily apparent as the description proceeds, the device comprises a keyboard for introducing pitch value information after the introduction of respective time value information, the introduced pitch value information being stored in a memory together with the introduced time value information, a circuit for producing pitch value control signals together with the time value control signals of the introduced sequency and a selectively operable audio frequency generator, which is influenced by both the time value control signals and the pitch value control signals.

According to a further embodiment of the invention the device can be constructed in such a way that a visual display is also provided which has several discrete optical elements having at least two different possible states and which change their state to reproduce the time values of the notes and/or the pauses and to make possible a simultaneous visual representation of the introduced sequence, which helps in the understanding of this sequence.

BRIEF DESCRIPTION OF THE DRAWINGS

The invention will be better understood and objects other than those set forth above will become apparent when consideration is given to the following detailed description thereof which makes reference to the annexed drawings, wherein:

FIG. 3 is a block diagram of an embodiment of the circuit of the invention; and FIG. 4 is a schematic representation of a white noise pulse which is generated by the signal emitting device of the invention.

DETAILED DESCRIPTION OF THE PREFERRED EMBODIMENTS

Figure 1:
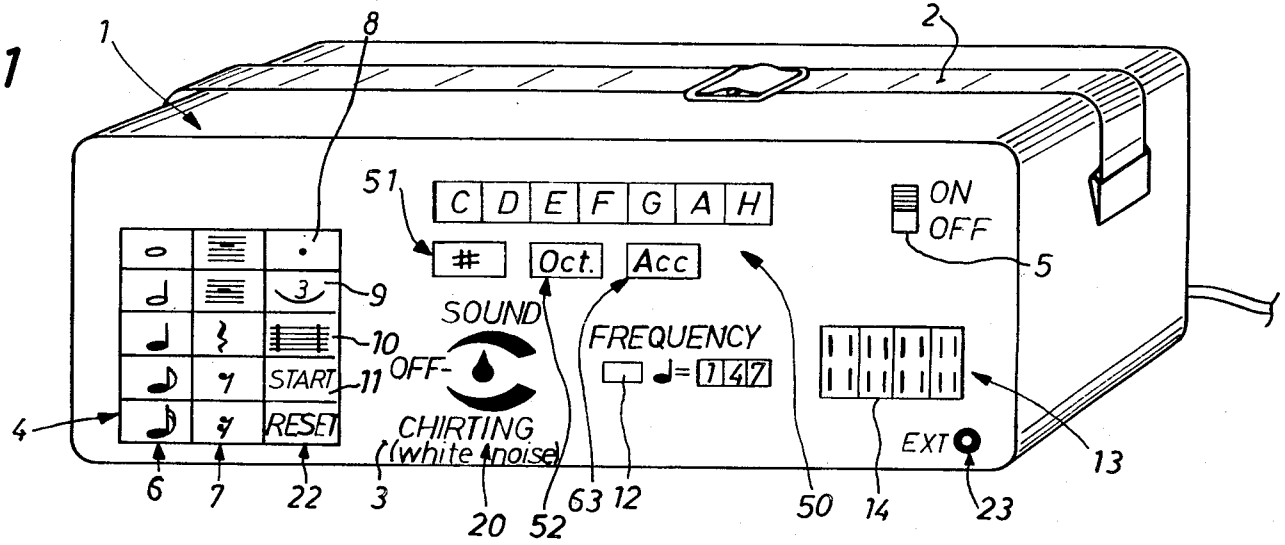
FIG. 1 is a representation of the front panel of an embodiment of a signal emitting device according to the present invention, showing the most important actuating elements thereof.

Describing now the embodiments of the invention shown in the drawings, the signal emitting device of FIG. 1 is stored in a housing 1 which is relatively flat as to be arranged beneath the music sheet located on a music stand. The housing 1 may be fixed to the music stand by a strap 2 or other device like hooks. The housing 1 is best arranged in such a way that its front panel appears in the visual field of the user at the same time as the music sheet he is reading. On the front panel are the most important input and visual output elements.

A time value keyboard 4 permits the user to introduce the sequence of time values of notes and pauses which should be reproduced and pitch value keyboard 50, in combination with an octave switch 52 and a halftone switch 51, permits user to introduce the pitch values of the notes.

The input occurs in the following manner: after the power is turned on (switch 5) and the reset (switch 22) is activated, the key buttons corresponding to the time values of the notes 6 and of the pauses 7 are depressed in correspondence with the notes of the rhythm to be reproduced. After each introduction of such a time value, a key button on keyboard 50 corresponding to the pitch value of this note is also actuated to introduce its pitch. For this purpose, in the embodiment shown in FIG. 1, seven key buttons are provided which represent the pitch values of one octave of the C-Major scale and are respectively marked.

For the introduction of halftones, the halftones key button 51 is actuated before the key button of the pitch value to be introduced, which increases the pitch of this note by a halftone. For the flat-scales the same halftone key button 51 is used before actuating the key button of the pitch which is one whole step below the note, the flat of which is to be reproduced. The octave key 52 displaces the introduced degree one octave up so that two octaves can be played, e.g. one lower octave 220–440 Hz and one upper octave 440–880 Hz.

In another example (not shown) the input of the pitch of the notes is done with a piano-like key array with a range of two octaves, the halftone key button 51 and the octave key 52 not being necessary. Dotted notes are obtained by actuating the dotted key 8 after the introduction of the time value of the note to be dotted by the key buttons of column 6.

Triplets are introduced by actuating the corresponding key button 9 before the introduction of the three notes building the triplet on the note sheet. During the introduction of the note or pause time values, the corresponding elements of the visual display are illuminated. After the introduction of a whole measure the bar switch 10 is actuated, which causes a new start in the visual display, as will be explained later.

In the present embodiment, within one measure, note and pause time values can be introduced up to the sum of 1, herewith the most important time signatures are available. In the present embodiment up to 8 measures can be introduced which also allows time signature changes, e.g. from 3/4 to 4/4 and back. When the sequence has been introduced, including the tone pitches, the start switch 11 is actuated. A foot pedal can also be used to give the start. First a whole silent measure is played (visual display only) in the rhythm of the first measure introduced, then the sequence is played with a frequency which has been selected before by setting frequency switch 12. The beat frequency is determined in relation to the $\frac{1}{4}$ note value as is usual (Metronome Mälzel) and can be adjusted in the given embodiment to any whole number between 0 and 299 (e.g. ♩=64 means 64 quarter notes in a minute), the switch for the hundreds being adjustable between 0 and 2, the other ones between 0 and 9.

A visual and an acoustic output which will be described provides the signals.

The visual display 13, according to the version of FIG. 1, consists in a series of optical elements; for example, four Seven Segments elements 14 of which only the vertical segments are used. The visual display occurs in such a way that, in correspondence with the selected frequency, vertical segments of the seven segments elements represent the time values according to their places in the measure and their lengths.

The time values of the notes are displayed in such a way that the segments of the seven segments elements light up sequentially with the frequency of the shortest displayable time value and do so as long as the whole time value of the selected note has been obtained. Then all corresponding segments stop shining at the same time. In a 4/4 time signature, in which the shortest displayable time values are 1/6 notes, the third $\frac{1}{4}$ note will, e.g. be visually displayed by the successive lighting up of the vertical segments of the third element in the rhythm of 1/16 notes and at the end of the $\frac{1}{4}$ note all the vertical segments of this third element stop shining at the same time. If on the other hand the third position of the measure is occupied by four 1/16 notes, each vertical segment of the third element will shine only for the duration of a 1/16 note and will stop emitting immediately after this value. For the display of uneven time signatures, e.g. $\frac{3}{4}$, less than the whole row of elements 13 will be actuated, and the display will start on the left again after the duration of one measure, in the example being considered, the last seven segments element 14 of the row will not be activated. Pauses will be displayed by jumping over the corresponding number of visual elements and duringg the pause no element will be lighted.

From the foregoing, it is clear that the described visual display can reproduce rhythms of the most possible time signatures whose time values per measure are less than or equal to 1 in sum, e.g. 2/2, 2/4, 4/4, 3/4, 6/8 which are the most usual time signatures. With a small modification of the described example, e.g. with the use of 5 or 6 elements 14 it is possible to display time signatures without the above mentioned limitation as for example 9/8, 12/8, 6/4, or 5/4.

Figure 2:
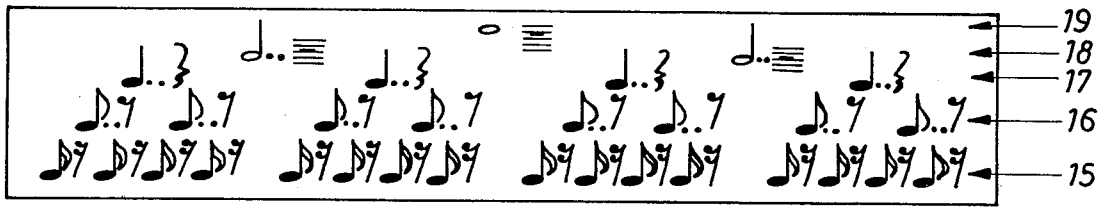
FIG. 2 is a representation of a second embodiment of the display visual of the device of FIG. 1.

In FIG. 2 another optical display is shown which functions according to the same principles as display 13 but in which each time value can be represented with its own symbol. The time values shown in FIG. 2 are to be formed by a liquid crystal display which becomes visible only when activated and otherwise remains invisible. The lowest row 15 is used for the display of 1/16 note values and triplets. This row is actuated in the same way as the single row of display 13 of FIG. 1. Additionally in one of the upper rows 16 to 19 the notes will be displayed during their entire time values. For example, to display a $\frac{1}{4}$ note, one element or row 17 (without dot) will shine during its entire time value and at the same time the length of this note can be perceived on the lowest row 15 where the light emitting devices flash for the length of a 1/16 note value in the already described manner.

Dotted notes are characterized by the supplementary lighting of a dot as can be understood with FIG. 2. This arrangement has, particularly for a beginner, the advantage that the display coincides largely with the symbols on the note sheet. As already mentioned, an acoustic output is also foreseen whose loudness can be controlled with switch 20 (FIG. 1) which can also switch it off.

The acoustic display has a loudspeaker 34 (FIG. 3) which is preferentially located on the upper or lower surface of the housing 1.

The tones are acoustically reproduced in the following manner: In a white noise position, the tone is sent to the loudspeaker 34 preferentially as a pulse of approximately 0.2 sec. in duration and having an exponentially decreasing amplitude, as shown schematically in FIG. 4, independently of the length of the note. In this way a very noticeable and timely precise reproduction of each beat is assured. In the sound mode, continuous sounds are audible which are interrupted shortly before the end of their time values in order to separate the notes from each other.

To mark certain notes of a measure (so-called good notes), each note can at the choice, of the operator, be reproduced louder than the other ones. The accentuation switch 63 serves for this purpose and is actuated, when introducing the sequence of notes to be reproduced, just after the note which is to be accentuated.

Switch 20 controls the loudness of the reproduction. In the position "off" the acoustic output is silent. In the position "white noise" the notes are each reproduced as a so-called white noise (random noise having a balanced frequency spectrum). This is particularly convenient when the device is used as a metronome.

When the device is used to learn a piece of music, the following procedure is advantageous. First the sequence of tones is introduced as already described. The reproduction first occurs optically and acoustically and the pitches are also reproduced. When the sequence has been understood in its rhythm and melody, the acoustic display can be switched to white noise and the student can be trained in this mode. Finally the acoustic display can be completely switched off and the training can be pursued with the aid of the visual display only. In each mode different time signatures are possible.

The device can also have on its front panel a decimal (three digits) measures counter: When the switch "start" is actuated and the device is running, this counter shows the number of played measures. This obviates the difficulty of having to count the measures during long pauses. A connection for external output is also located on the front panel to interconnect electrically several similar devices and start them at the same time so that if they are set at the same frequency, the play of an ensemble can be considerably facilitated, particularly with the help of the visual display, in comparison with the usual optical signal giving devices.

In a further embodiment an external output for a headgear or a tape recorder is provided, the use of the last mentioned device being especially advantageous when long sequences should be played or when many voices are to be reproduced.

The above functions can be obtained by the electronic circuit illustrated in FIG. 3. Keyboard 4 for the time values and keyboard 50 for the pitch values are each connected to a first input unit 24. The frequency switch 12 is connected to a second input unit 25. Both input units are connected to a microprocessor and memory 27 through an 8-bit-databus 26 for introducing the note sequence (time values and pitch values).

The microprocessor 27 has a quartz oscillator which oscillates at a frequency of 4 MHz and a reset input 35. The microprocessor 27 is connected by a 11-Bit Addressbus to a read only memory 30, in which a function program is stored.

The read only memory 30 is also connected to an 8-bit-databus 26 which leads to an output unit 31. To this last unit are connected the optical display 13 formed by the elements 14, the measures counter 32 with the measures counter display 21, a phase locked loop-circuit (PLL-Circuit) which serves as frequency synthesizer 53 to generate various sound frequencies, and a white noise generator 56.

The PLL-Circuit 53 receives the digital information concerning the pitch and generates a frequency which corresponds to the frequency of the introduced note. This frequency signal is conducted to an amplifier 55 through a switch 54, which can be actuated by switch 20 of the front panel, and to which the white noise generator is also connected.

The amplifier 55 is controlled by the output unit 31 in such a way that the white noise pulses have an exponential decrease of amplitude and a duration of about 0.2 sec. Amplifier 55 under control of output unit 31, is also responsible for the increase in amplitude of the sounds corresponding to the accentuated notes which have been accentuated by the accentuation switch 63.

In another embodiment of the invention (not shown) the signal emitting device comprises an 8-bit word decoder (so-called character generator) at one of its outputs. This output can be connected to a dot matrix printer or an analog printer for printing the played sequence on paper tape or the like. Thereby it is possible to record the selected sequence in visible form. This output is also connectable to a standard CRTC (cathode ray tube controller) which modulates radio frequency signals, which in turn are entered into the antennae input of a standard home TV set. Thereby, the visible effects can be enhanced. Another version of the inventive device comprises a floppy magnetic disk on which the selected sequences are recorded. Thereby the recorded sequences later can be entered without using the keyboards. Finally, in another embodiment an input is provided for reading the above mentioned print out on a paper tape. Thereby a recorded sequency also can be reentered without using the keyboards.

The described signal emitting device has many uses. As already mentioned, it can be used in musical and rhythmic teaching in various modes and allows a particularly favorable didactic approach of music notes.

It can be used as a metronome and as a music instrument playing back introduced note sequences.

It can also be combined with other electronic sound synthesizers, e.g. electronic organs.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A signal emitting device, comprising:

an input unit which enables the user of said device to input both a sequence of time values of musical notes and pauses and the respective pitch values of each of said musical notes;

a memory for storing said inputted values;

an acoustic output device; and a central circuit connected to said memory and said acoustic output device and operable in both a first and a second mode, the mode that said control circuit is operated in being selectable by the user of said signal emitting device, said control circuit causing said acoustic output device to generate a melody corresponding to said entered time and pitch values when said control circuit operates in said first mode, said control circuit causing said acoustic output device to generate pulsed white noise signals of equal duration but varying spacing determined by said entered time values when said control circuit operates in said second mode.

2. A signal emitting device as claimed in claim 1, wherein said input unit comprises:

a time value keyboard for inputting said sequence of time values of musical notes and pauses; and a pitch value keyboard for entering said pitch values.

3. A signal emitting device as claimed in claim 1, wherein said input unit also permits the use of said signal emitting device to enter a selected beat frequency and wherein said control circuit generates said melody in said first mode and said white noise signals in said second mode as a function of said beat frequency.

4. A signal emitting device as claimed in claim 1, wherein said input unit and said memory cooperate to permit the user of said signal emitting device to enter a number of time values of musical notes or pauses equal to at least one measure.

5. A signal emitting device as claimed in claim 1, wherein said white noise signals have an exponentially decreasing amplitude which is independent of said sequence of time values.

6. A signal emitting device as claimed in claim 2, further comprising an input switch which permits the user of said signal emitting device to identify selected ones of said notes of said sequence of notes to be amplified by said variable amplifier by a greater degree than the non-selected notes.

7. A signal emitting device as claimed in claim 1, further comprising a visual output unit having a plurality of discrete diaplay elements, each of which has at least two optically different states and being settable into one of these two states in a manner which is characteristic for the type of a note and for its place within said introduced sequence, wherein the visual output is connected to said control circuit and is operable independently of said acoustic output unit such that said entered sequence can be displayed by said visual output unit only.

8. A signal emitting device as claimed in claim 7, wherein said visual output unit comprises at least sixteen visual elements groupined in four groups of four, each visual element corresponding to one of the sixteen sixteenth notes within a measure, these elements being activatable in accordance with said introduced sequence.

9. A signal emitting device as claimed in claim 8, wherein said visual output unit comprises several groups of optical elements, each group corresponding to one of several note and pause time values and constituting at least one measure to be displayed, one of said optical elements being enabled at any given intant, said optical elements being sequentially displaying the time values of said notes and pauses of said introduced sequence.

10. A signal emitting device as claimed in claim 8, wherein said control circuit causes said visual output unit to optically represent one note of a certain time value within a measure by causing the elements of a corresponding group of visual elements to be sequentially placed in an active state at a frequency of the smallest displayable time value and to remain in this state until the end of the time value to be displayed, at which time said elements return to a non-active state.

* * * * *